United States Patent [19]

Kifferstein et al.

[11] 4,143,483

[45] Mar. 13, 1979

[54] SOUND-EMITTING TOY FLYING SAUCER

[76] Inventors: Harry P. Kifferstein, 27250 Harvard Rd., Southfield, Mich. 48076; Warren M. Kifferstein, 29632 Middlebelt, Farmington Hills, Mich. 48024

[21] Appl. No.: 805,127

[22] Filed: Jun. 9, 1977

Related U.S. Application Data

[63] Continuation-in-part of Ser. No. 739,653, Nov. 8, 1976, Pat. No. 4,117,626, which is a continuation-in-part of Ser. No. 653,786, Jan. 30, 1976, abandoned.

[51] Int. Cl.[2] ..... A63H 33/18

[52] U.S. Cl. ..... 46/74 D

[58] Field of Search ..... 46/74 D, 75; 273/106 B

[56] References Cited

U.S. PATENT DOCUMENTS

| | | | |
|---|---|---|---|
| 3,758,985 | 9/1973 | Heisler | 46/74 D |
| 3,959,916 | 6/1976 | Meyer | 46/74 D |
| 3,959,917 | 6/1976 | Dawson | 46/74 D |

FOREIGN PATENT DOCUMENTS

| | | | |
|---|---|---|---|
| 1603662 | 5/1971 | France | 46/74 D |

*Primary Examiner*—Louis G. Mancene
*Assistant Examiner*—Robert F. Cutting
*Attorney, Agent, or Firm*—Hauke and Patalidis

[57] ABSTRACT

An improvement relating to a toy flying saucer having a double skinned body defining lower and upper wall portions joined proximate the rim of the toy flying saucer body. The upper and lower walls, in one embodiment, are normally urged in close proximity and may be manually separated so as to form a variable volume air chamber therebetween. An orifice in one of the walls is provided with a noise-making element such as a whistle or a siren. Prior to launching the flying saucer, the upper and lower walls are manually separated so as to fill the chamber therebetween with air which is allowed to escape during flight through the orifice provided with a noise emitting element. Alternatively, the double skinned body is constructed such that the upper and lower walls are normally urged away from each other such as to form an air chamber therebetween which can be manually collapsed prior to launching of the toy flying saucer. Air entering the chamber passes through the noise emitting element inserted in an orifice in one of the walls.

The improvement of the invention consists in at least one biasing element disposed between the upper and lower walls in the air chamber which normally urges the walls away from each other such as to expand the air chamber, or towards each other such as to collapse the air chamber. The biasing element greatly improves the functioning of the variable capacity air chamber, and renders the sound-emitting toy flying saucer foolproof in operation.

7 Claims, 10 Drawing Figures

FIG. 1
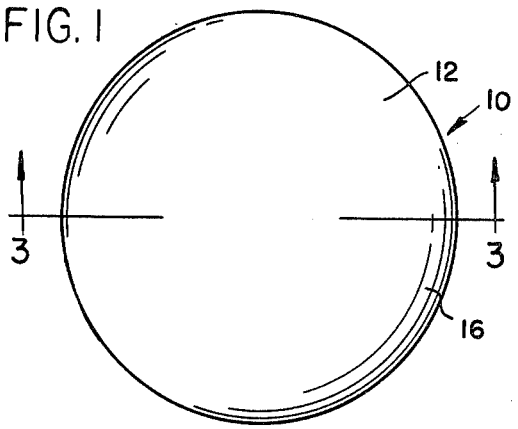
FIG. 2
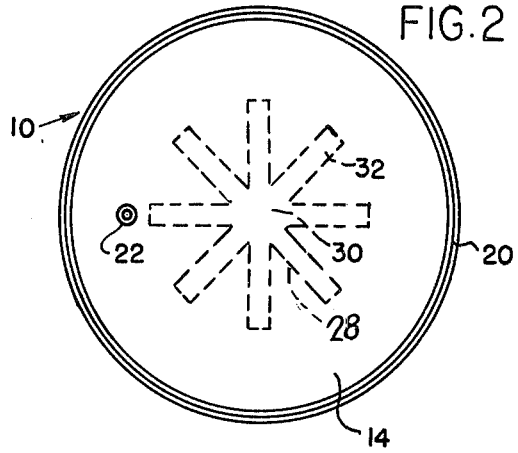
FIG. 3
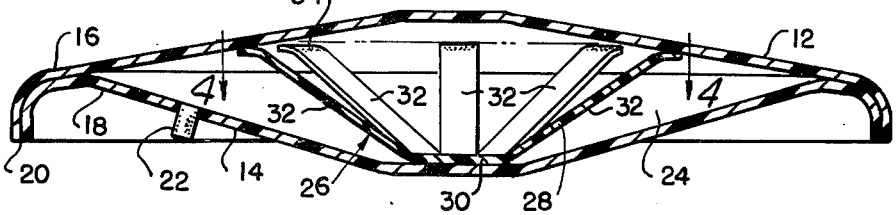
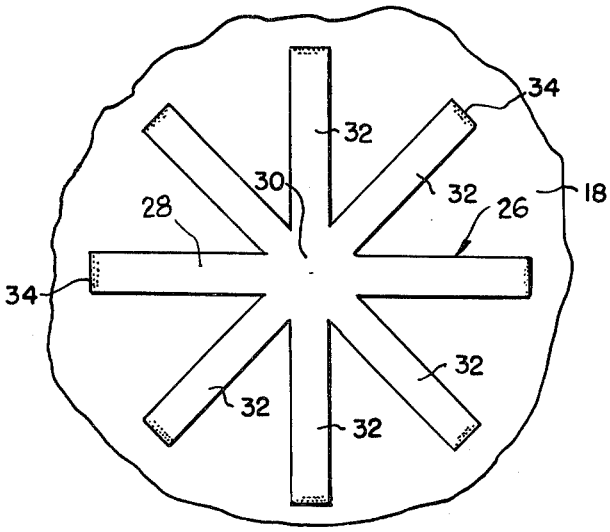
FIG. 4
FIG. 5
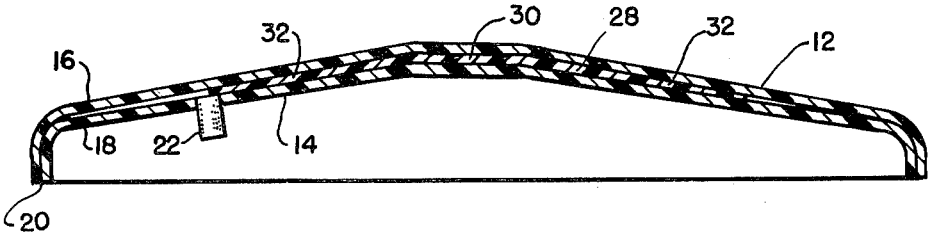

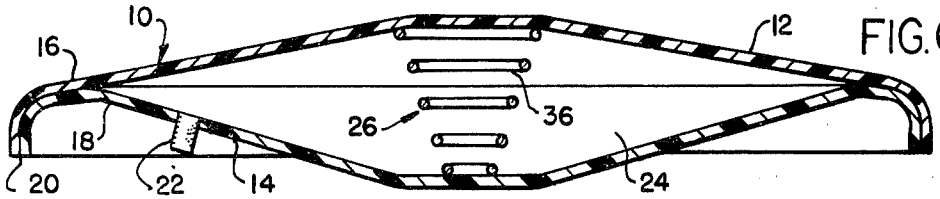
FIG. 6
FIG. 7
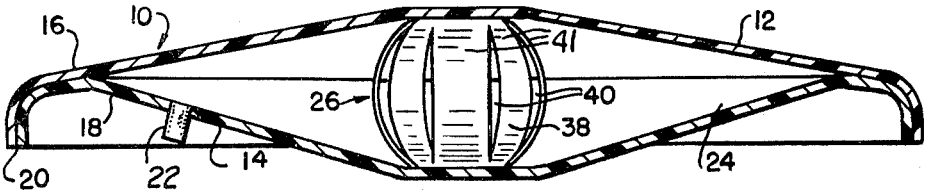
FIG. 8
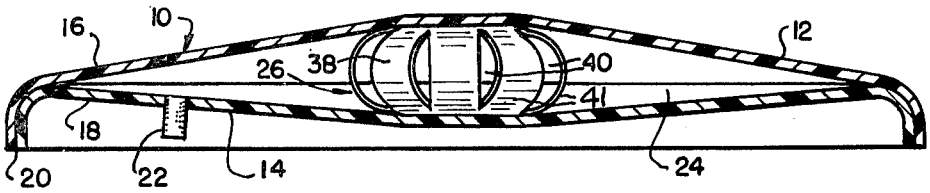
FIG. 9
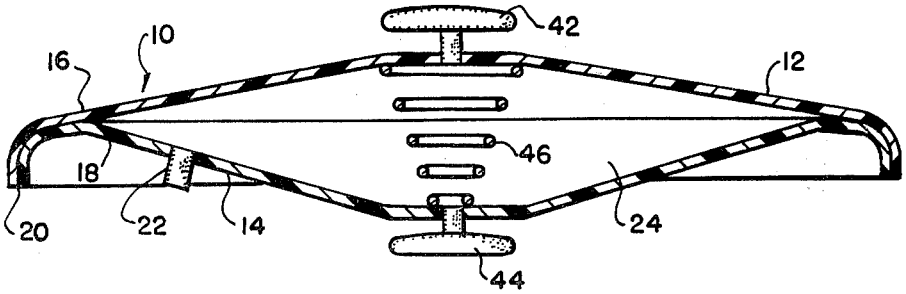
FIG. 10
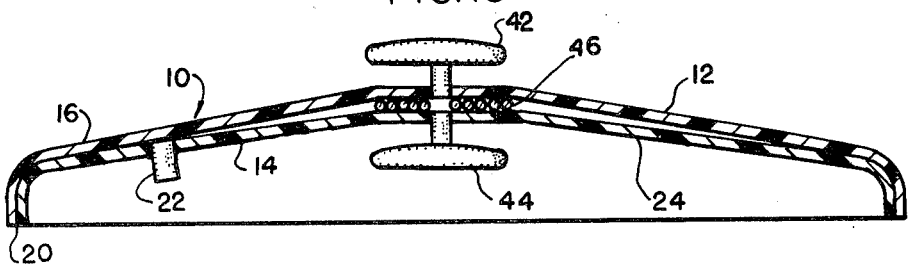

SOUND-EMITTING TOY FLYING SAUCER

CROSS-REFERENCE TO RELATED APPLICATIONS

This application is a continuation-in-part of application Ser. No. 739,653, filed Nov. 8, 1976, now issued as U.S. Pat. No. 4,117,626 of Oct. 3, 1978, which is a continuation-in-part of application Ser. No. 653,786, filed Jan. 30, 1976, now abandoned.

BACKGROUND OF THE INVENTION

The present invention relates to improvements to saucer-shaped flyable toys which can be manually thrown and caused to sail through the air with a spinning motion. Typically, such saucer-shaped flyable toys have a curved convex upper surface and a corresponding curved concave lower surface, the surfaces ending in a turned down rim which is manually grasped for tossing the toy in the air with a spinning motion.

Conventional toy flying saucers are generally capable of soaring silently through the air. It is readily apparent that if such toys were capable of emitting a sound while being sailed through the air and spinning, additional enjoyment would result from such characteristics of the toy.

Attempts have been made in the past to provide toy flying saucers with noise making devices, as disclosed for example in U.S. Pat. Nos. 3,900,986 and 3,900,987, by providing the outer periphery or rim of the toy with whistles. However, the inconveniences of such whistles mounted on the rim of the toy are many. The whistles may interfere with the flight characteristics of the toy flying saucer, they substantially increase the drag and do not operate if the toy is spun too slowly or in a direction opposite to that normally operating the whistles. In addition, if some of the whistles are reversed for providing a sound effect irrespective of the direction of rotation of the toy, silent flights are not available at will, as spinning of the flying saucer is a prerequisite to obtaining a correct flight trajectory.

SUMMARY OF THE INVENTION

The present invention is an improved toy flying saucer having superior flight characteristics and having the additional feature of emitting a sound at the will of the user, such sound-emitting quality being independent from and not interfering with the flight characteristics of the toy. The objects and advantages of the present invention are achieved by modifying the structure of conventional amusement devices known as toy flying saucers by providing a double-skinned dome-shaped body with manual means for forming between a dome-shaped upper wall and a dome-shaped lower wall a variable volume air chamber, with appropriate apertures permitting to expel air from the chamber manually prior to launching, and by placing in the flow of air into the chamber a noise-emitting device operable in flight when the two wall portions of the body are caused to be resiliently displaced away from each other, thus increasing the volume of the chamber and introducing air therein. At least one resilient biasing element is permanently disposed in the chamber between the upper and lower walls, thus normally urging the upper and lower walls away from each other. Alternatively, the resilient biasing element may be arranged to urge the upper and lower walls towards each other, and means are provided for manually separating the walls prior to launching such that the noise-emitting element is activated when air is expelled from the chamber.

The many objects and advantages of the present invention will become apparent to those skilled in the art when the following description of the best modes contemplated for practicing the invention is read in conjunction with the accompanying drawing wherein like reference numerals relate to like or equivalent elements and in which:

BRIEF DESCRIPTION OF THE DRAWING

FIG. 1 is a top plan view of a noise-making toy flying saucer according to the invention;

FIG. 2 is a bottom plan view thereof;

FIG. 3 is a transverse section along line 3—3 of FIG. 1;

FIG. 4 is a partial view from line 4—4 of FIG. 3;

FIG. 5 is a view similar to FIG. 3, but showing the noise-making toy flying saucer of the invention with its air chamber collapsed;

FIG. 6 is a view similar to FIG. 3, but showing a modification thereof;

FIG. 7 is a view similar to FIG. 3, but showing a further modification thereof;

FIG. 8 is a view similar to FIG. 7, but showing the air chamber partially collapsed;

FIG. 9 is a view similar to FIG. 6, but showing a further modification of the invention; and FIG. 10 is a view similar to FIG. 9, but showing the air chamber in a collapsed condition.

DETAILED DESCRIPTION OF THE PREFERRED EMBODIMENTS

Referring now to the drawing and more particularly to FIGS. 1–4 thereof, a toy flying saucer according to the present invention has a generally circular body 10, dome-shaped such as to define an upper convex surface 12 and a lower concave surface 14. As best shown at FIGS. 3 and 5, the body 10 is double-skinned, that is, provided with an upper wall body portion 16 and a lower wall body portion 18 each dome-shaped and both joined at or proximate their respective edges such as to form a downwardly oriented rim 20. Both the upper and lower dome-shaped wall portions 16 and 18 are preferably molded of a light plyable plastic material, such material being conventionally and conveniently used in prior art toy flying saucers. The two wall portions 16 and 18 are united at the rim 20, or proximate thereto, by any convenient means such as by cementing, by heat or supersonic welding, or by dimensioning the lower wall portion 18 with a larger outer diameter than the inner diameter of the upper wall portion 16 such that the lower wall portion 18 is elastically joined to the upper wall portion at, or proximate to, the rim 20. The latter construction, although providing a good seal at the surfaces in engagement, permits to separate at will the two wall portions and to fly each separately as an individual toy flying saucer.

The lower wall portion 18 is provided with an orifice in which is disposed a noise-making element 22 similar to the noise-making element disclosed in the aforesaid U.S. Pat. No. 4,117,626. When separated, the lower wall portion 18 and the upper wall portion 16 form therebetween a chamber 24 which at FIG. 3 is shown extended. The lower wall portion 18 and the upper wall portion 16 are normally urged away from each other by the particular configuration of the wall, when molded, and by way of a resilient biasing means 26 which, in the form illustrated at FIGS. 1–5, consists of a spider-shaped spring member 28 which comprises a substantially flat base portion 30 fastened to the interior surface of the lower wall portion 18 substantially at the center and provided with a plurality of integral upwardly bent legs 32, extending radially and upwardly such that the end 34 of each spring leg 32 engages the lower surface of the upper wall portion 16. The spider-shaped spring element 28 may be made of any appropriate thin, light metal spring material or, preferably, it is made of a flexible resilient plastic material such as polyethylene or the like, preferably with the end 34 of each spring leg 32 slightly rounded such as to engage the bottom surface of the upper wall section 16 without gouging. The spider-shaped element 28 is molded with the spring legs 32 normally disposed at an angle relative to the base 30 such that the action of the spring element 28 tends to relatively separate the upper wall portion 16 and the lower wall portion 18, as shown at FIG. 3, thus expanding the air chamber 24 therebetween to its maximum capacity. Prior to launching the toy flying saucer, the air chamber 24 is collapsed by manually urging the upper wall portion 16 and the lower wall portion 18 in close proximity to each other, as shown at FIG. 5, thus flattening the spring element 28. After launch, under the biasing action of the spring element 28, with the spring legs 32 tending to reoccupy their original position at an angle relative to the base 30 thereof, the lower wall portion 18 and the upper wall portion 16 are urged away from each other, thus filling the chamber 24 with air flowing through the noise-making element 22.

FIG. 6 illustrates a modification wherein the biasing means 26 tending to urge the upper and lower wall portions 16 and 18 away from each other, such as to expand the air chamber 24, consists of a coil spring 36 disposed between the walls substantially at their center, the coil spring 36 being preferably of the type provided with consecutive spirals of constantly decreasing diameter such that, in its collapsed form, the spring 36 occupies a space corresponding to the thickness of the material forming the spring coil, each consecutive spiral being nested within the preceding one.

FIG. 7 illustrates a further modification wherein the biasing means 26 consists of a ball or sphere 38 made of a resilient material, such as thin rubber or plastic, which is slit from proximate one pole to proximate the other pole as shown at 40, such as to form a plurality of meridian sectors 41 which tend to separate from each other, the amount of maximum separation being situated at the equator of the ball 38 when pressure is applied on the ball tending to collapse it by urging its opposite poles in close proximity to each other, a partial collapse of the ball 38 being shown at FIG. 8, which causes the sectors 41 to be widely spread apart. The bending of the sectors 41 of the ball 38 causes pressure to be applied to the inside surfaces of the upper wall section 16 and of the lower wall section 18 thus normally urging them apart and tending to increase the size of the air chamber 24, causing air to be introduced into the air chamber through the noise making element 22.

FIGS. 9–10 illustrate an arrangement wherein the upper wall portion 16 and the lower wall portion 18 of the toy flying saucer body 10 are manually spread apart by way of pulling on knobs 42 and 44 mounted respectively at the center of the upper wall portion 16 and of the lower wall portion 18, prior to launching the toy flying saucer. Air is thus introduced through the noise-making element 22 or, alternatively, through an appropriate check valve, not shown, as explained in the aforesaid copending application, into the chamber 24 formed between the upper and lower wall portions. The tendency of the upper and lower wall portions 16 and 18 to spring back in close proximity is enhanced by a coil spring 46 acting in tension and having its ends appropriately attached to the inside of the upper and lower wall portions 16 and 18. The action of the coil spring 40 tends to collapse the chamber 24 by causing the upper and lower walls portions 16 and 18 to be urged toward each other, to the position illustrated at FIG. 10, thus expelling air from the chamber 24 through the noise-making element 22.

Although a single noise-making element 22, mounted through an aperture in the lower wall portion 18 of the flying saucer body 10 has been illustrated throughout the several views, it will be readily apparent that more than one noise-making element may be used, either disposed in an aperture in the lower wall portion or the upper wall portion, or both, without departing from the spirit or the scope of the present invention.

Having thus described the invention by way of typical practical examples thereof, modifications whereof will be apparent to those skilled in the art, what is claimed as new is as follows:

1. In a toy flying saucer comprising a substantially circular dome-shaped body and a downwardly extending rim formed at the periphery of said body, said body being made of lower and upper separable wall portions joined proximate said rim, at least one of said wall portions being made of a resiliently deformable material, an aperture provided in one of said wall portions, and an air flow actuated noise-making element disposed in said aperture for emitting a sound when said wall portions are allowed to be resiliently displaced relative to each other thus causing air to circulate through said noise-making element, the improvement comprising biasing means disposed between said lower and upper wall portions and operatively connected to said wall portions for displacing said wall portions relative to each other for causing air to circulate through said noise-making element.

2. The improvement of claim 1 wherein said upper and lower wall portions are normally urged in close proximity with each other by said biasing means and further comprising means for manually separating said lower and upper wall portions for forming therebetween a chamber filled with air introduced therein.

3. The improvement of claim 2 wherein said biasing means is a coil spring.

4. The improvement of claim 1 wherein said upper and lower wall portions are normally urged away from each other by said biasing means.

5. The improvement of claim 4 wherein said biasing means is a coil spring.

6. The improvement of claim 4 wherein said biasing means is a hollow sphere made of relatively thin resilient material having meridian slits.

7. The improvement of claim 4 wherein said biasing means is a spider-shaped flat spring element having a base member engaged with one of said wall portions and at least a pair of spring legs projecting from said base member at an angle and each having a free end in engagement with the other of said wall portions.

* * * * *